US008636380B2

(12) United States Patent
Burkard et al.

(10) Patent No.: US 8,636,380 B2
(45) Date of Patent: Jan. 28, 2014

(54) LIGHTING MODULE, LIGHTING DEVICE COMPRISING A LIGHTING MODULE, METHOD FOR ASSEMBLING A LIGHTING MODULE AND METHOD FOR ASSEMBLY OF A LIGHTING DEVICE

(75) Inventors: Klaus Burkard, Regensburg (DE); David Dussault, Neutraubling (DE); Peter Sachsenweger, Zeitlarn (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/502,332

(22) PCT Filed: Oct. 13, 2010

(86) PCT No.: PCT/EP2010/065325

§ 371 (c)(1), (2), (4) Date: Apr. 16, 2012

(87) PCT Pub. No.: WO2011/045336

PCT Pub. Date: Apr. 21, 2011

(65) Prior Publication Data

US 2012/0206917 A1 Aug. 16, 2012

(30) Foreign Application Priority Data

Oct. 16, 2009 (DE) ..... 10 2009 049 664
Mar. 10, 2010 (DE) ..... 10 2010 002 728

(51) Int. Cl.
*F21V 29/00* (2006.01)
*H01R 12/00* (2006.01)

(52) U.S. Cl.
USPC ..... 362/249.02; 439/62; 439/67; 362/800; 362/382; 362/396

(58) Field of Classification Search
USPC ..... 313/512; 362/800, 249.02, 249.01, 382, 362/396; 439/62, 67
See application file for complete search history.

(56) References Cited

U.S. PATENT DOCUMENTS

2006/0033431 A1 2/2006 Hsieh
2009/0206718 A1 8/2009 Shimonishi et al.

FOREIGN PATENT DOCUMENTS

DE 100 38 559 10/2001
EP 1 496 488 1/2005
JP 2002 033011 1/2002
WO WO 2006/044434 4/2006

*Primary Examiner* — Joseph L Williams
(74) *Attorney, Agent, or Firm* — Cozen O'Connor

(57) ABSTRACT

A lighting module (1; 7; 11; 31; 41; 61; 71; 81; 91; 97; 109; 115), comprising: a circuit board (2), on which are mounted at least one component (3; 12; 22; 32; 42; L; 92; 99; 108; 116; 119) and at least one attachment element; (5; 98), wherein the at least one attachment element (5; 98) is fastened on the at least one component (3; 12; 22; 32; 42; L; 92; 99; 108; 116; 119) mounted on the circuit board (2) in a locking manner.

17 Claims, 19 Drawing Sheets

LIGHTING MODULE, LIGHTING DEVICE COMPRISING A LIGHTING MODULE, METHOD FOR ASSEMBLING A LIGHTING MODULE AND METHOD FOR ASSEMBLY OF A LIGHTING DEVICE

RELATED APPLICATIONS

This is a U.S. national stage of application No. PCT/EP2010/065325, filed Oct. 13, 2010.

This application claims the priority of German application nos. 10 2009 049 664.5 filed Oct. 16, 2009 and 10 2010 002 728.6 filed Mar. 10, 2010, the entire content of both of which are hereby incorporated by reference.

FIELD OF THE INVENTION

The invention relates to a lighting module, comprising at least one circuit board, on which at least one component, comprising at least one light source, and at least one attachment element are mounted. The invention furthermore relates to a lighting device comprising at least one lighting module and one cooling body. The invention also relates to a method for assembling a lighting module and a method for assembling a lighting device.

BACKGROUND OF THE INVENTION

FIG. 1 shows an oblique exploded view of a lighting module S1 according to the prior art, comprising a retaining ring S2, into the front side of which a circuit board S3 is inserted. Four light emitting diodes L are fastened in corresponding insertion locations S5 on the front side of the circuit board S3. The light emitting diodes L are designed as surface-mounted components (surface mounted device, SMD). A reflector S6 which serves as a common reflector for all four light emitting diodes L is in turn fitted onto the circuit board S3, whereby each light emitting diode L has its own reflector region S6*a*. The reflector S6 is retained by means of snap-in hooks S7 projecting forwards from the retaining ring S2, which engage laterally in corresponding locking recesses S8 on an upper edge of the reflector S6.

FIG. 2 shows an oblique view of a back side S3*b* of the assembled lighting module S1, whereby the back side S3*b* of the lighting module S1 is not flat throughout due to the design because the retaining ring S2 protrudes backwards or to the rear over the circuit board S3. This does however make it more difficult to shape a suitable cooling body (not illustrated) for the lighting module S1 because for optimized heat dissipation from the light emitting diodes L the cooling body is best fastened directly on the back side S3*b* of the circuit board S3 in a planar manner. A step in height is however introduced by the retaining ring S2. For fastening the lighting module S1 to the cooling body, in order to ensure sufficient stability a screw connection is provided which renders necessary a thread or a screw hole S9 in the circuit board S3. The incorporation of such a thread S9 in the circuit board S3 is complex and not achievable by simple means on a commercial scale.

SUMMARY OF THE INVENTION

One object of the present invention is to provide a lighting device comprising at least one lighting module which can be effectively cooled by a cooling body and can be assembled simply.

This and other objects are attained in accordance with one aspect of the present invention directed to a lighting module, comprising a circuit board, on which are mounted at least one component and at least one attachment element, wherein the lighting module is preferably provided with the back side thereof for fastening to a cooling body and whereby the at least one attachment element is fastened in a locking manner to the at least one component mounted on the circuit board. The at least one component mounted on the circuit board comprises at least one light source.

Apart from the at least one light source, the circuit board can also comprise further electrical and/or electronic components, such as resistors, driver devices, jumpers, terminals etc.

The light source is not restricted to one particular type and can comprise halogen lamps, fluorescent tubes, incandescent lamps and/or semiconductor light sources. A light emitting diode (single light emitting diode or light emitting diode cluster) is however preferred as the light source. The light emitting diode can be an inorganic light emitting diode or an organic light emitting diode (OLED).

As a result of the fact that the attachment element is provided for locking to a component disposed on the circuit board, the attachment element does not need to reach through the circuit board or to be locked by means of a retainer receiving the circuit board as shown in FIG. 1 and FIG. 2. Consequently, no projections which impede a planar fastening of the circuit board to the cooling body are formed protruding on the back side of the circuit board. A lighting module can thus be achieved which can be thermally effectively cooled by means of a cooling body on account of the planar contact region.

The attachment element can basically be any element to be attached onto the lighting module. On account of the locking fastening or locking connection, the attachment element (locking attachment element) is preferably not an electrical or electronic element and therefore provides no electrical function.

It is an embodiment that the attachment element is an optical element assigned to the light source. The attachment element can thus be disposed at least partially in one of the at least one light source, light path or light cone. The optical element can be an optically active element for beam guidance and/or beam modification (for example a reflective or diffractive element such as a reflector, lens, light diffusing cover etc.) or an optically inactive element such as a transparent cover disk.

It is another embodiment that the attachment element is fastened to a (dedicated) locking element. The locking element has primarily or exclusively a locking function. In other words, the locking element is primarily or exclusively intended as part of a locking connection. This has the advantage that the locking element can be designed specifically for its locking function. In addition, the lighting module does not need to be altered or only needs to be altered slightly in order to receive the locking element.

It is a further embodiment that the attachment element is fastened to an electrical connection element in a locking manner. The electrical connection element is a component for providing an electrical connection or link and can for example be a male or female connector. The electrical connection element thus also has a locking means or a locking function. The surface occupancy on the circuit board is thus reduced and the lighting module can be implemented more compactly.

It is another embodiment that the attachment element is fastened to the at least one light source in a locking manner. The light source thus also has a locking means or a locking function. This means that the surface occupancy on the circuit board is reduced and the lighting module can be implemented more compactly. Such a locking facility is moreover advantageous for an optical component because the latter can thus be positioned in a simple manner close to and with little play on the at least one light source.

It is also an embodiment that at least the component is a surface-mounted component. In addition to a simple insertion capability, this also has the advantage that it does not need to be taken through the circuit board and thus also does not produce any unevenness (projections, solder bumps etc.) on the back side of the circuit board.

It is additionally a particularly advantageous embodiment that the circuit board is completely equipped with surface-mounted components.

It is another embodiment that the attachment element is fastened in a locking manner to the component by means of at least one pair consisting of a locking spring and a locking pin which can be inserted in a locking manner into the locking spring. Such a type of locking facility can be simply locked and released again. Furthermore, this type of locking facility can be automated for an insertion process.

It is also another embodiment that the attachment element is fastened in a locking manner to the component by means of at least one pair consisting of a locking receptacle and a locking hook hooking laterally on the locking receptacle. Such a type of locking facility can be simply locked and can be automated for an insertion process.

In the case of a locking receptacle designed as a surface-mounted component (SMD), this can in particular be designed as a locking bracket.

In the case of a light source, an electrical connection element or another component, the locking receptacle can be formed for example in an associated housing, for example as a lateral locking recess in the housing.

It is also another embodiment that the attachment element is fastened in a locking manner to the component by means of at least one pair consisting of a locking receptacle provided with an opening and a locking pin which can be inserted into the opening. Such a type of locking facility can also be simply locked and can be automated for an insertion process.

The locking pin can for example be a slotted locking pin or locking hook. The locking receptacle can also be incorporated in a locking bracket or a contact terminal. The locking receptacle can additionally be designed as a locking recess in the top of a housing.

It is furthermore an embodiment that the attachment element is fastened in a locking manner to the component by means of at least one pair consisting of a locking plate provided with an opening and a slotted locking pin which can be inserted into the opening, whereby the opening in the locking plate is situated above a recess in the circuit board. This type of locking facility can likewise be simply locked and can be automated for an insertion process.

It is furthermore an embodiment that the lighting module has at least one pawl for securing the locking fastening of the attachment element to the component. It is thereby possible to prevent the attachment element from becoming detached.

It is a preferred development for precise positioning of the attachment element that the attachment element has at least one positioning pin. The component which can be locked with the attachment element and/or the circuit board can have a corresponding positioning hole.

It is furthermore advantageous if at least one part of a locking connection is designed in such a manner that a locking connection can be established in at least two different locking positions. This means that it is possible to make an adjustment for measurement tolerances through a choice of locking position. The contact force of the components connected by means of the locking connection can also be set and it is possible to also connect one or both components to components having other dimensions.

The object is furthermore achieved by a lighting device which comprises at least one such lighting module and also at least one cooling body, whereby the at least one lighting module is fastened by its back side to the at least one cooling body in a planar manner. A plurality of lighting modules can therefore be fastened to one cooling body. This enables particularly simple and effective cooling and simple assembly.

Another aspect of the present invention is directed to a method for assembling a lighting module, wherein the method comprises at least the following steps:

equipping a circuit board with components employing SMT technology; and locking at least one attachment element to at least one of the SMT components.

Another aspect of the present invention is directed to a method for assembling a lighting device, wherein the method comprises at least the following step: planar application of at least a back side of the circuit board to a cooling body.

The methods can generally be developed in an analogous fashion to the embodiments of the lighting module or of the lighting device.

It is generally possible to assign the components of a locking connection (locking pin/locking spring; locking hook/locking receptacle, etc.) to the attachment element or to the component mounted on the circuit board. For locking purposes the attachment element can thus comprise at least one locking pin and/or at least one locking hook, and the component can comprise at least one appropriate locking spring and/or at least one appropriate locking receptacle. Alternatively or additionally, for locking purposes the component can comprise or be at least one locking pin and/or at least one locking hook, and the attachment element can comprise at least one appropriate locking spring and/or at least one appropriate locking receptacle. In each case, the components of the locking connection can if required therefore be present on the other element (component, attachment element).

BRIEF DESCRIPTION OF THE DRAWING

For clarity, the same elements or elements having the same function are identified by the same reference characters in the figures.

DETAILED DESCRIPTION OF THE DRAWING

Figure 3:
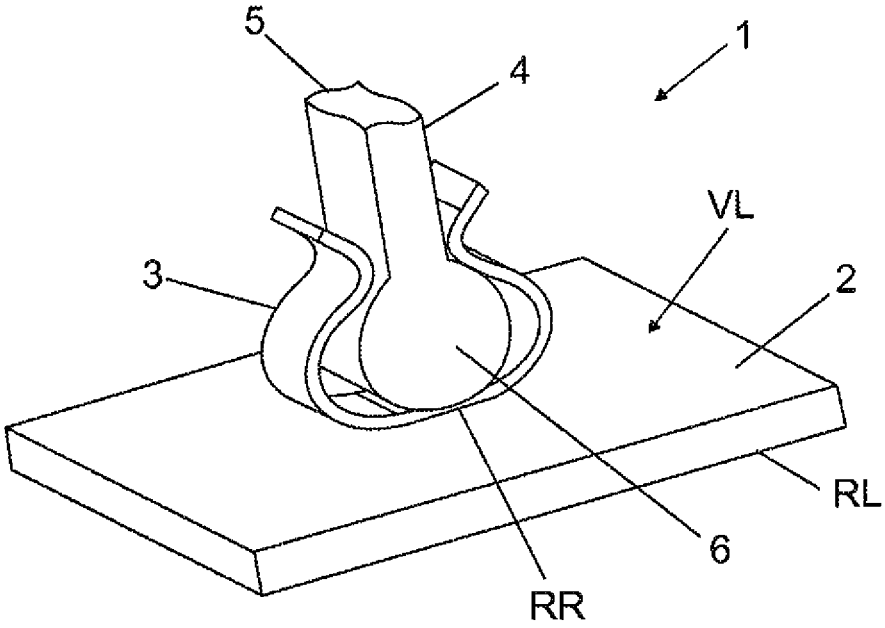
FIG. 3 shows an oblique view of parts of a lighting module according to a first embodiment, which lighting module constitutes a part of a lighting device.

FIG. 3 shows parts of a lighting module 1 according to a first embodiment, whereby the lighting module 1 comprises a circuit board 2 for fastening at least one light source (not illustrated) and at least one optical element 5 assigned to the light source, namely on a front side VL of the circuit board 2. The lighting module 1 is provided on the back side RL of the circuit board 2 for fastening to a cooling body (not illustrated). The at least one optical element 5 can be fastened in a locking manner to the circuit board 2 by means of at least one component disposed on the circuit board 2. In the first exemplary embodiment, a pair consisting of a locking spring 3 as the component and a locking pin 4 which can be inserted in a locking manner into the locking spring 3 as part of the optical element 5 is provided for locking fastening purposes.

The locking spring 3 has an essentially "U"-shaped or vase-shaped cross-section. The locking spring 3 is connected by its back side or underside RR in a planar manner with the front side VL of the circuit board 2. In the concrete exemplary embodiment, the locking spring 3 has been fitted surface mounted by means of an SMT (surface mounted technology) method on the circuit board 2. In other words, the locking spring 3 is designed here as an SMT component, and the locking pin 4 constitutes a retaining means for an optical element 5 which for improved clarity is not illustrated in its entirety.

In order to fasten the optical element 5 on the lighting module 1, the locking pin 4 which has a widened locking head 6, is pressed from above into the locking spring 3. Since a width of the locking head 6 is greater than a width of an opening in the locking spring 3, the locking spring 3 is pushed apart by pressing in the locking pin 4 until the locking head 6 is situated in the interior of the locking spring 3. The locking spring 3 then springs back elastically and retains the locking head 6 of the locking pin 4. In order to release the locking connection or snap-in connection, the locking pin 4 can be pulled out of the locking spring 3 with a predetermined force which is sufficient for pushing the locking spring 3 apart.

The pair shown comprising the locking spring 3 and the locking pin 4 thus constitute a releasable locking connection. By dimensioning the locking head 6 and the opening of the locking pin 4 and by dint of the material properties of the locking spring 3, in particular the modulus of elasticity and a wall thickness, the fastening force or release force can be precisely set. Such a pair consisting of the locking spring 3 and the locking pin 4 can be manufactured very simply and is free from wear.

Figure 4:
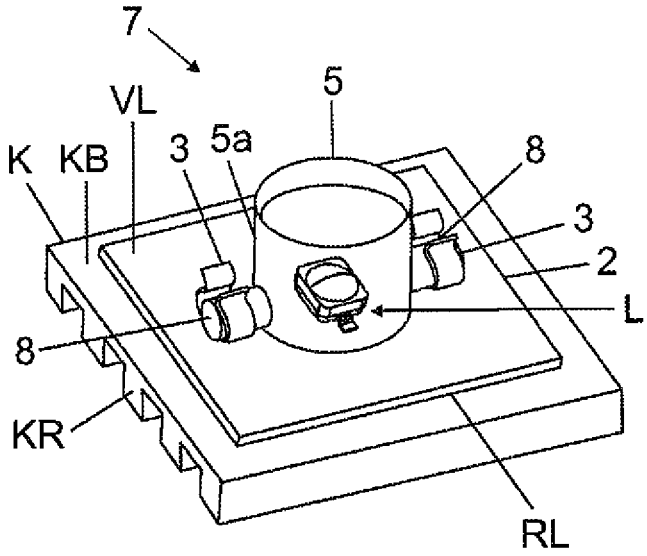
FIG. 4 shows an oblique view from above of a lighting module according to a second embodiment.
Figure 5:
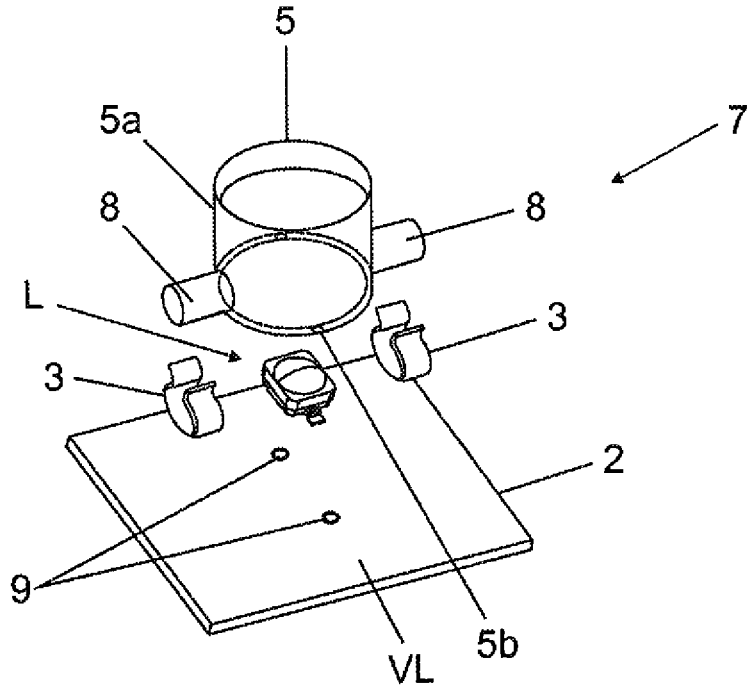
FIG. 5 shows an oblique exploded view from above of the lighting module according to the second embodiment.

FIG. 4 shows an oblique view from above of a lighting module 7 according to a second embodiment having a locking connection similar to that from FIG. 3 with the optical element 5 in an assembled state. FIG. 5 shows an oblique exploded view from above of the lighting module 7.

The optical element 5 is disposed on the circuit board 2 such that it encloses an individual light emitting diode L. The optical element 5 can for example be a reflector. Two cylindrical projections 8 go off on opposite sides in a lower region on the outside 5*a* of the optical element 5. These projections 8 fulfill the same function as the locking head 6 of the locking pin 4 of the lighting module 1 from the first embodiment, namely that they can engage or snap into corresponding locking springs 3. The locking springs 3 are fastened as SMT components directly on the front side VL of the circuit board 2.

In order to assemble the parts of the lighting module 7 shown here it is necessary merely to equip the circuit board 2 with the light emitting diode L and the two locking springs 3 in SMT technology, and subsequently to engage or snap the optical element 5 into the locking springs 3. To ensure correct positioning of the optical element 5, the latter can comprise one or more positioning projections 5*b* on its underside which can be inserted into corresponding positioning holes 9 in the circuit board 2.

The lighting module 7 is fastened with the flat back side RL of the circuit board 2 in a planar manner on a plane attachment region KB of a cooling body K, for example by means of a thermally conductive adhesive or a thermal interface material (TIM). On the side facing away from the attachment region KB the cooling body K comprises a plurality of cooling ribs KR. The lighting module 1 and the cooling body K form one part of a lighting device V. The lighting device V can comprise further elements, not shown, such as electrical and/or electronic components, terminal elements, etc.

Figure 6:
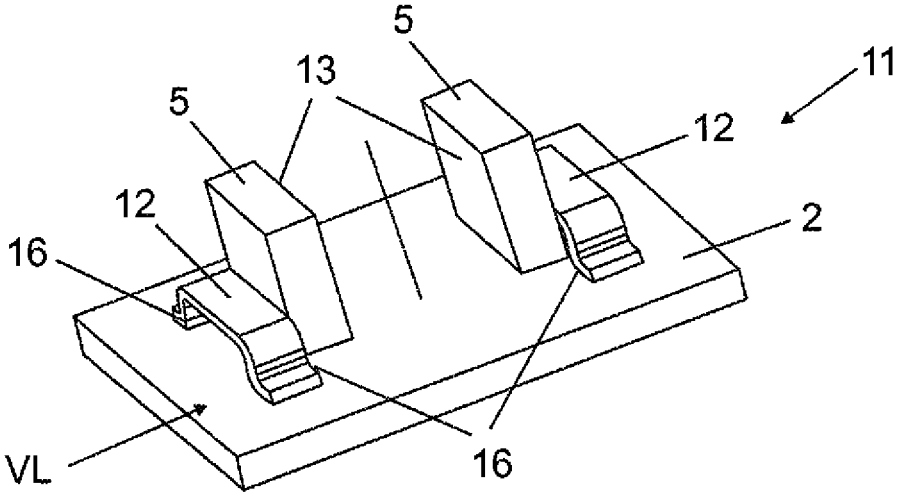
FIG. 6 shows an oblique view from above of parts of a lighting module 11 according to a third embodiment.
Figure 7:
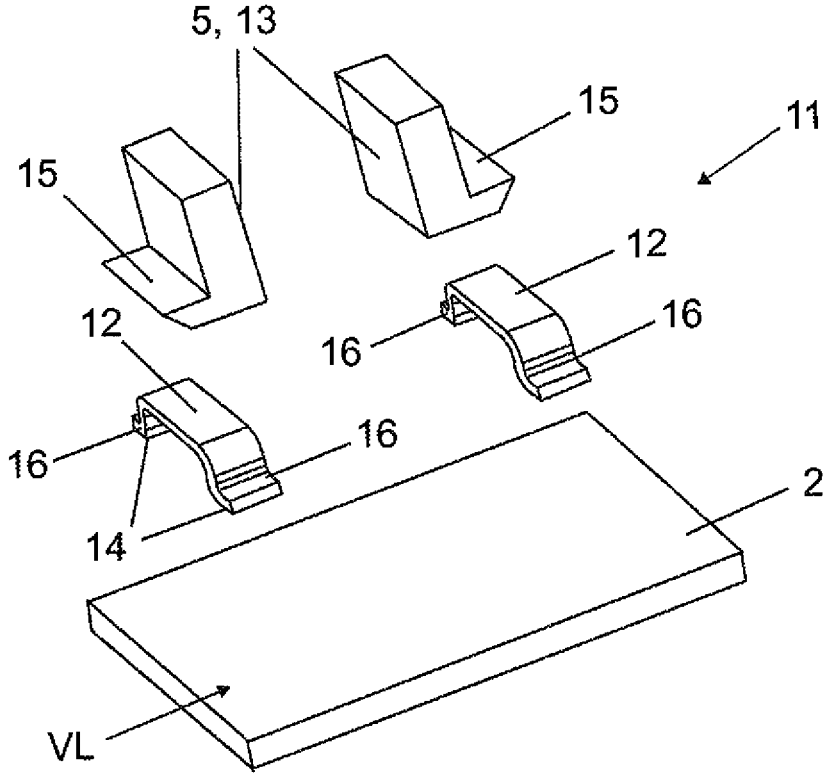
FIG. 7 shows an oblique exploded view of the lighting module according to the third embodiment.

In FIG. 6, a locking connection is established between the optical element 5 and the lighting module 11 by means of two pairs each consisting of a locking receptacle 12 and a locking hook 13 hooking laterally on the respective locking receptacle 12. FIG. 7 shows an oblique exploded view of the lighting module 11.

The locking hooks 13 are a part of an optical element 5 which is not shown in further detail. The locking receptacles 12 are designed as locking brackets which form an upturned U-shape in cross-section and have two laterally outgoing lugs 16, by means of the underside 14 of which they can be fastened on the front side VL of the circuit board 2, preferably using SMT technology. For locking purposes the optical element 5 is lowered onto the circuit board 2 until the locking hooks 13 hook in beneath the locking receptacles 12 with their lateral locking projections 15. Such a design is also simple to make available. In addition, the operation to lock the optical element 5 is possible by means of a simple linear movement and can thus also be automated.

Figure 8:
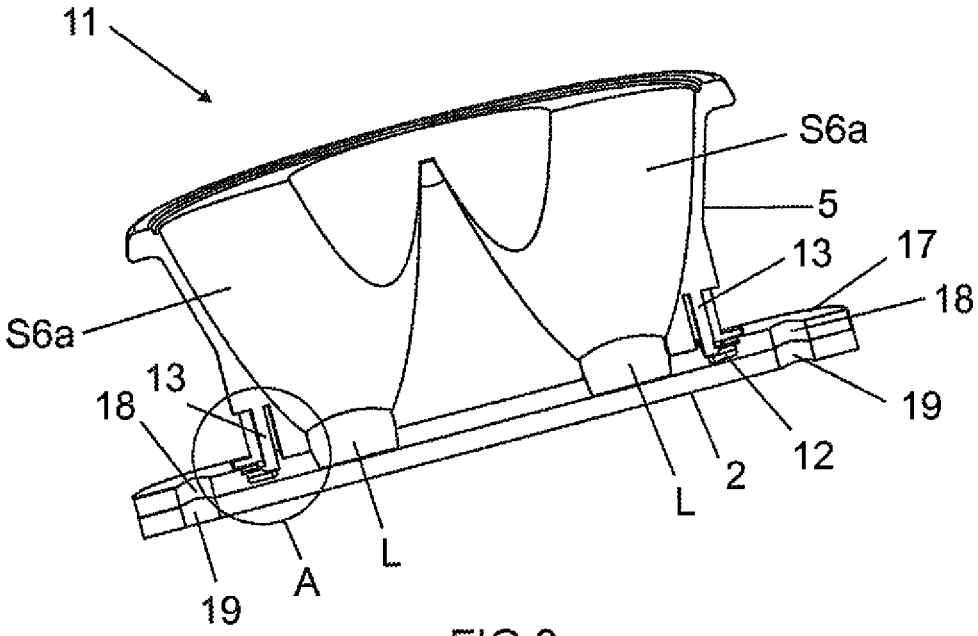
FIG. 8 shows a full side view of a locked lighting module according to the third embodiment.
Figure 9:
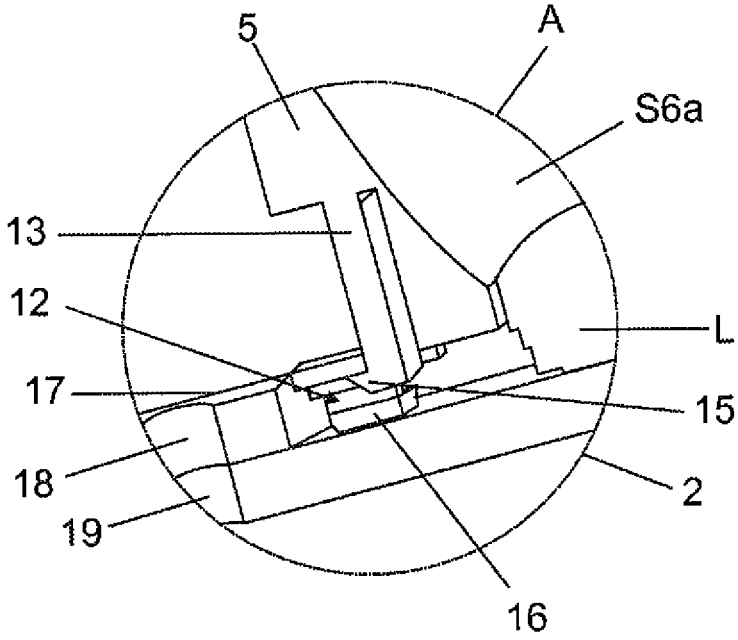
FIG. 9 shows a detail from the lighting module according to the third embodiment in the region of the locking connection.

FIG. 8 shows a full view of the lighting module 11 in the arrangement shown in FIG. 4 and FIG. 5 consisting of a plurality of pairs of locking hooks 13 and locking receptacles 12 in the form of locking brackets. FIG. 9 shows a detail A from the lighting module 11 in the region of the locking connection 13, 12.

Figure 1:
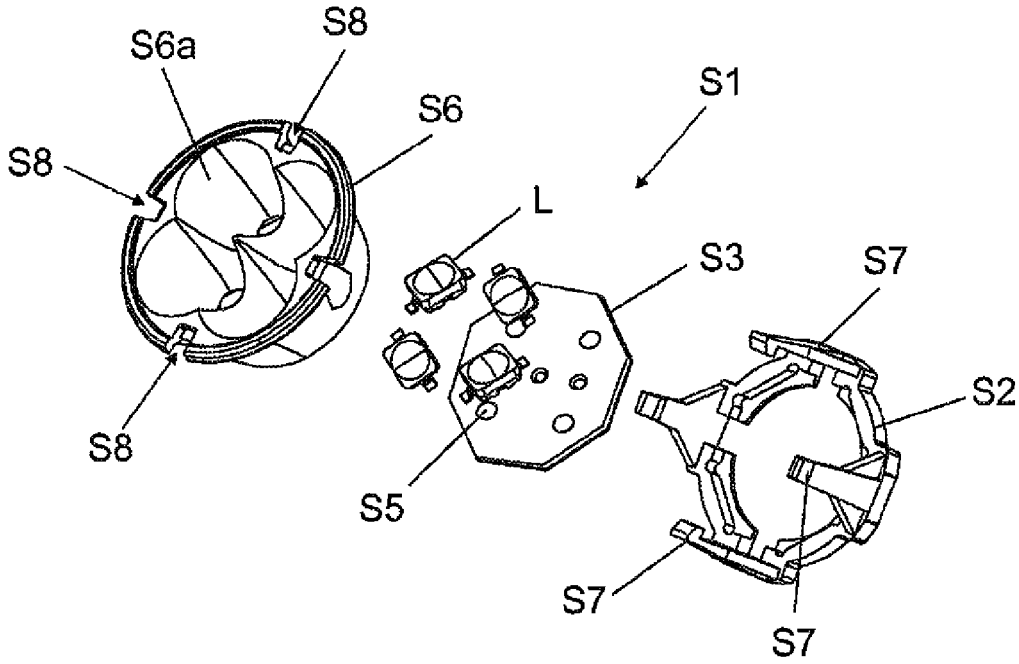
FIG. 1 shows an oblique exploded view of a lighting module according to the prior art.
Figure 2:
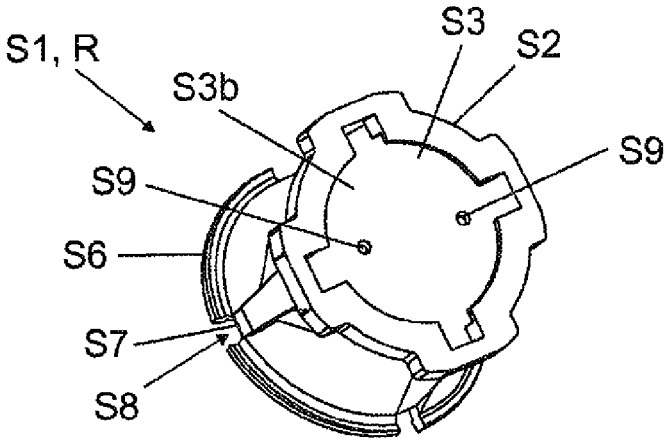
FIG. 2 shows an oblique view of a back side of the lighting module shown in FIG. 1.

Similar to FIG. 1 and FIG. 2, the optical element 5 is designed as a reflector for four light emitting diodes L, whereby a separate reflector region S6*a* is provided for each of the light emitting diodes L. The locking hooks 13 of the optical element 5 are directed downwards so as to engage or snap into the locking receptacles 12 which are surface mounted directly on the circuit board 2. The optical element 5 furthermore comprises lateral lugs 17 which comprise a through-hole 18 and bear on the circuit board 2 in a planar manner. The circuit board 2 likewise comprises through-holes 19 matching the through-holes 18. The combination of the through-holes 18, 19 may for example serve as a positioning recess for positioning the lighting module 11 on a cooling body.

Figure 10:
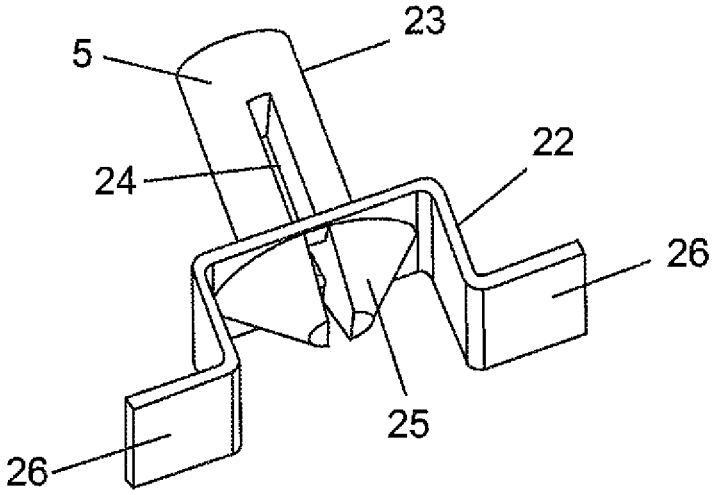
FIG. 10 shows an oblique view from below of a further locking connection between the optical element and the circuit board in a locked state.
Figure 11:
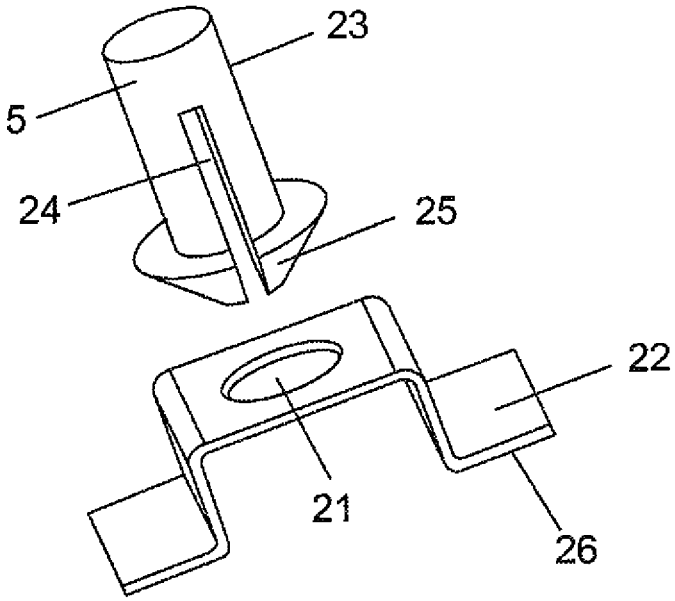
FIG. 11 shows an oblique view from above of the locking connection illustrated in FIG. 10 in a non-locked state.

FIG. 10 shows an oblique view from below of a further locking connection between the optical element 5 and the circuit board, consisting of a pair comprising as a component a locking receptacle 22 provided with an opening (21 in FIG. 11) and a locking pin 23 of the optical element 5 which can be inserted into the opening 21. FIG. 11 shows an exploded view or an oblique view from above in a non-locked state of the locking connection illustrated in FIG. 10.

The locking pin 23 is here essentially implemented axially symmetrically and has a continuous slot 24, by means of which the locking pin 23 can be compressed laterally. This enables a locking head 25 of the locking pin 23 to fit through the opening 21 onto the locking receptacle 22 when the locking pin 23 is pressed on. The locking receptacle 22 is implemented similarly to the locking receptacle 12 of the second exemplary embodiment, apart from the fact that it has the opening 21. The locking receptacle 22 is thus a surface-mounted component, SMD, whereby the locking receptacle 22 can be fastened on the circuit board by its two bearing surfaces 26.

Figure 12:
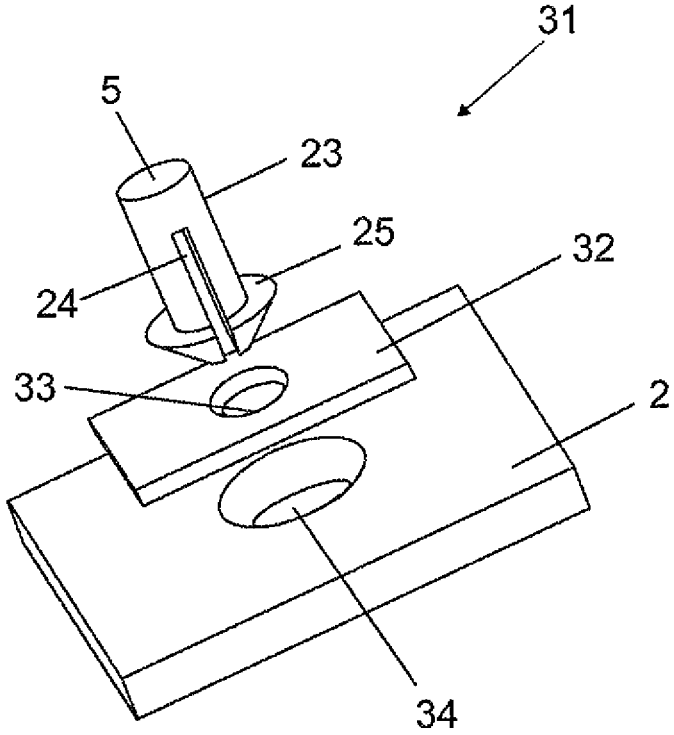
FIG. 12 shows an oblique view from above of a lighting module according to a further, fourth embodiment.
Figure 13:
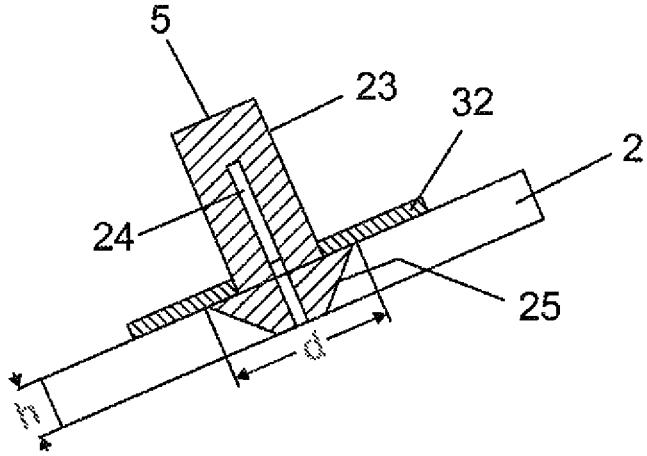
FIG. 13 shows an oblique sectional view of the lighting module of the fourth embodiment in the region of a locking of the optical element on the circuit board.

FIG. 12 shows an oblique view from above of a lighting module 31 according to a further embodiment. FIG. 13 shows an oblique sectional view of the lighting module 31 in the region of a locking of the optical element 5 on the circuit board 2.

The locking receptacle 32 is implemented here as a plane plate which has at its center an opening 33 in the form of a drilled hole as a lead-through for the locking pin 23. The locking receptacle 32 is fitted as a surface-mounted component directly on the circuit board 2, whereby the opening 33 is situated above a recess 34 in the circuit board 2. In this situation, the recess 34 in the circuit board 2 has a greater diameter d than the opening 33. Also, the recess 34 has a diameter d which is only slightly smaller than the diameter of the locking head 25 of the locking pin 23 in the relaxed state.

In order to lock the optical element 5 to the lighting module 31 the slotted locking pin 23 is pressed into the opening 33 of the locking receptacle 32 designed as a locking plate and thereby introduced into the recess 34. Since a height of the locking head 25 is less than a height h of the circuit board 2, in the assembled or locking state the locking head 25 does not protrude downwards out of the circuit board 2, which means that the capability to mount the lighting module 31 in a planar manner on a cooling body or another base remains guaranteed.

Figure 14:
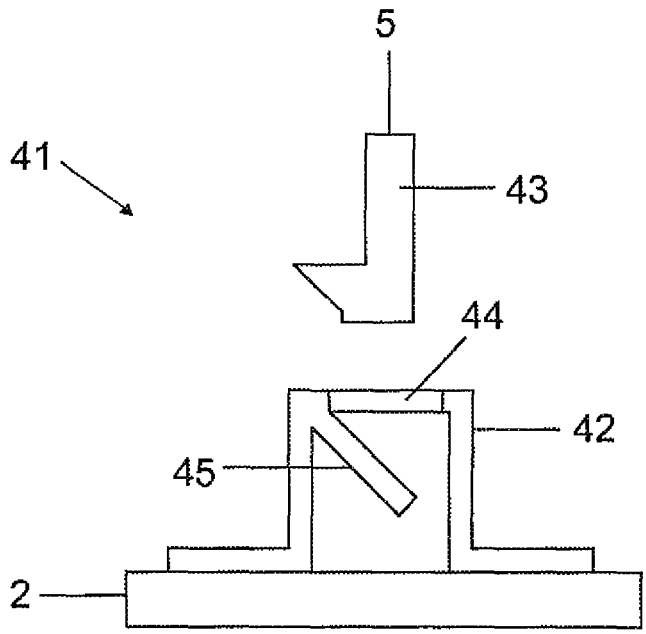
FIG. 14 shows a side sectional view of a lighting module, wherein the optical element has not yet been assembled.
Figure 15:
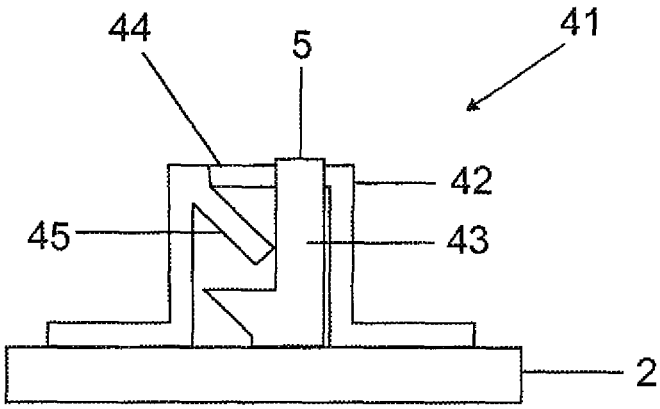
FIG. 15 shows the same lighting module of the fifth embodiment when the optical element has been assembled by locking.

FIG. 14 shows a side sectional view of a further lighting module 41, wherein the optical element 5 has not yet been assembled; and FIG. 15 shows the same lighting module 41 when the optical element 5 has been assembled by locking. This lighting module 41 comprises at least one pair consisting of a bracket-shaped locking receptacle 42 and a locking hook 43 of the optical element 5. The bracket-shaped locking receptacle 42 has been assembled on the circuit board 2 using surface mounted technology (SMT). The locking hook 43 can be brought to engage with the locking receptacle 42 in a locking manner through an opening 44 in the locking receptacle 42. In order to prevent the locking hook 43 from disengaging with the locking receptacle 42, the locking receptacle 42 here has a pawl or catch 45.

Whereas in the above exemplary embodiments the optical element 5 engages on components 3, 12, 22, 32, 42 which are designed as locking elements specifically provided for the purpose, exemplary embodiments are shown in the following wherein the optical element 5 is locked to components which have at least one further function.

Figure 16:
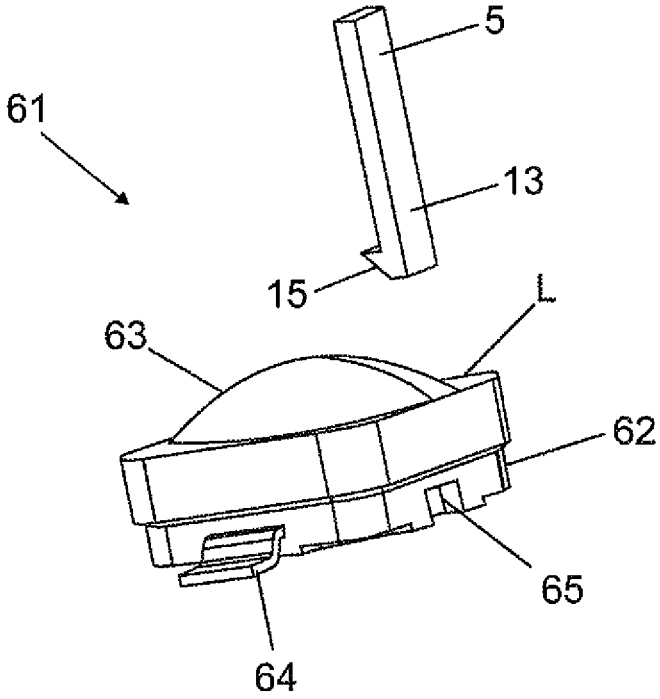
FIG. 16 shows an oblique view of elements of a lighting module according to a sixth embodiment in a non-locked state.

FIG. 16 shows an oblique view of elements of a lighting module 61, namely a light emitting diode L and a locking hook 13 as part of a not yet locked optical element 5. The light emitting diode L comprises a housing 62 which has a light emission area on an upper surface (not illustrated), whereby the light emission area is covered by an LED optical system 63. The LED optical system 63 can for example be used for beam shaping, for example for beam spreading or beam focusing, of the light emitted from the emission area. For its power supply the light emitting diode L has two laterally outgoing contact terminals 64. The contact terminals 64 are lug-shaped and suitable for being fastened using an SMT method on a conductor path or a conductor area of the circuit board 2. The light emitting diode L as such thereby also becomes a surface mounted component (SMD).

For fastening the optical element 5, for example a reflector, the housing 62 has a locking recess 65 on the side, in which the lateral locking projection 15 or the locking tab of the locking hook 13 can engage in a locking manner. The light emitting diode L can also comprise a plurality of such locking recesses 65, for example if the optical element 5 is to be retained by the light emitting diode L alone. Alternatively, a plurality of light emitting diodes L can each comprise one or more locking recesses 65 which lock as a group with corresponding locking hooks 13 of the optical element 5.

Figure 17:
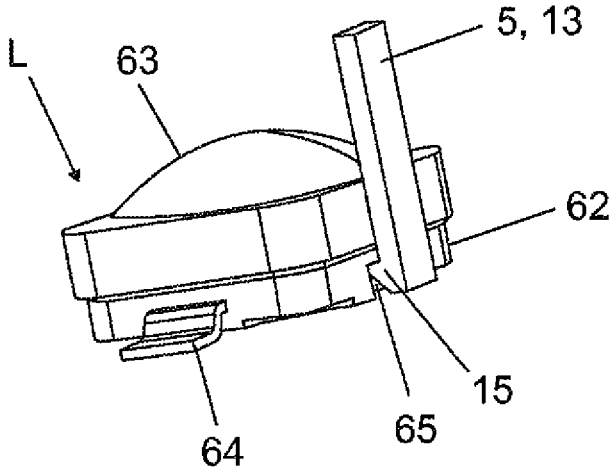
FIG. 17 shows the elements of the lighting module according to a sixth embodiment in a locked state.

FIG. 17 shows the elements of the lighting module 61 with the locking hook 13 locked in the locking recess 65. The locking can be achieved by simply placing and pressing the optical element 5 onto the light emitting diode L.

Figure 18:
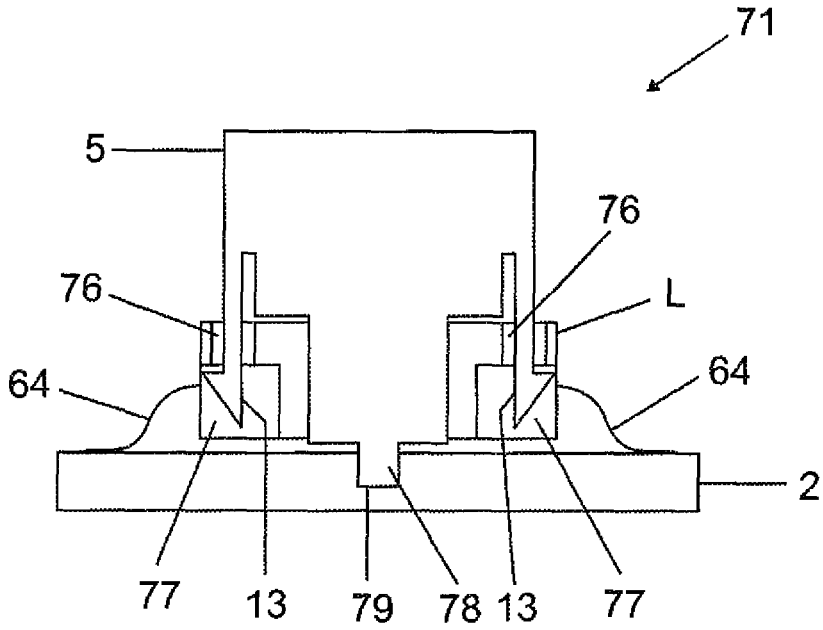
FIG. 18 shows a side sectional view of a lighting module according to a seventh embodiment having a light emitting diode onto which the optical element is snapped as a primary lens.
Figure 19:
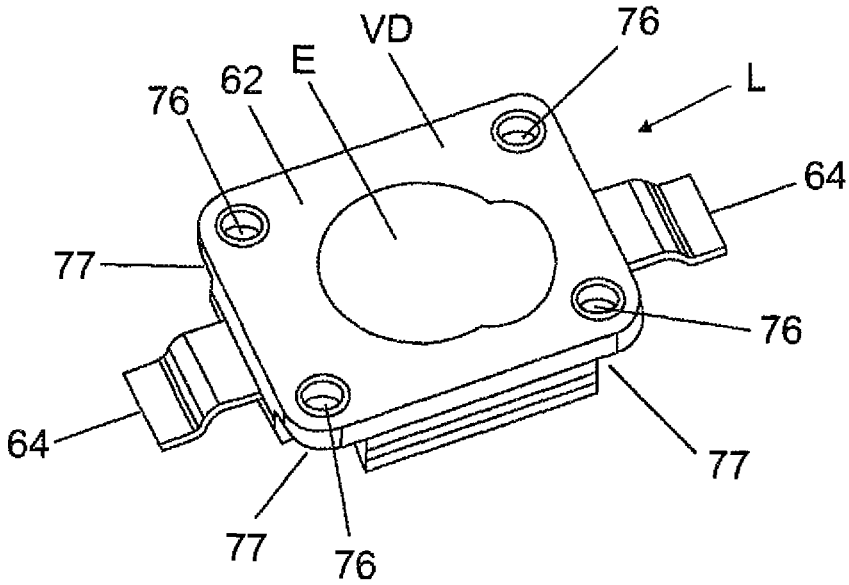
FIG. 19 shows an oblique view from above of the light emitting diode of the lighting module according to the seventh embodiment.

FIG. 18 shows a side sectional view of a lighting module 71 having a light emitting diode L onto which the optical element 5 is snapped as a primary lens. FIG. 19 shows an oblique view from above of the light emitting diode L.

The light emitting diode L comprises the lateral contact terminals 64 for SMD mounting on the circuit board 2. The light emitting diode L furthermore comprises on its front side or upper side VD a light emission area E. In the region of each of its corners the light emitting diode L furthermore comprises a mounting hole 76 which connects the upper side VD of the light emitting diode L with a recess 77 on the lower side. The mounting holes 76 are provided so that locking hooks 13 are passed through them. The locking hooks 13 are then received in the respective recesses 77 where they lock with the light emitting diode L. For correct positioning, the optical element 5 has a downward projecting projection in the form of a positioning pin 78 which can be introduced into a corresponding positioning receptacle or positioning hole 79 in the circuit board 2, as shown in FIG. 18.

Figure 20:
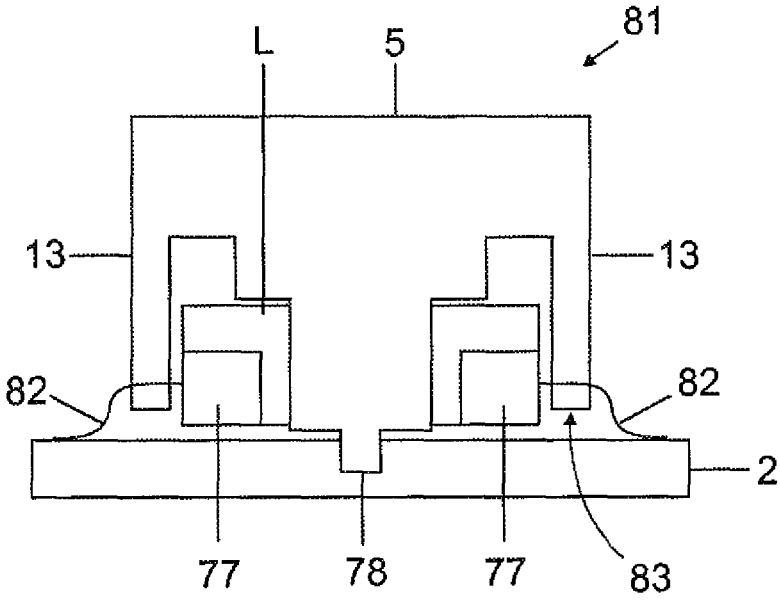
FIG. 20 shows a side sectional view of a lighting module according to an eighth embodiment.

FIG. 20 shows a lighting module 81 similar to the lighting module 71, whereby the locking hooks 13 here do not lock in the housing 62 but in the terminal lugs 82 of the light emitting diode L. The terminal lugs 82 are formed similarly to one half of the locking receptacle 12 from FIG. 4 and can for example comprise an opening 83 similar to the opening 21 in the locking bracket from FIG. 11 for passing through the respective locking hook 13.

Figure 21:
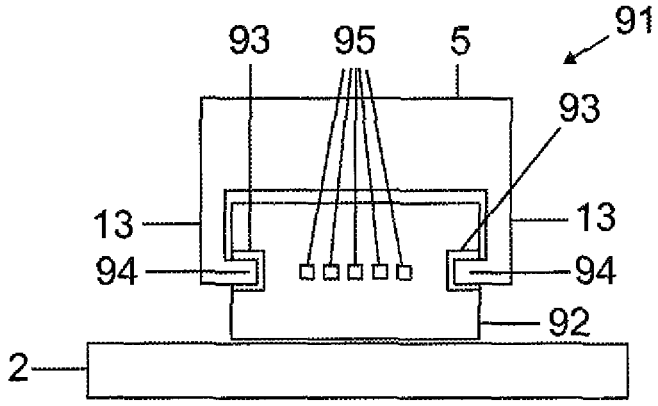
FIG. 21 shows a front view of a lighting module according to a ninth embodiment.

FIG. 21 shows a front view of a lighting module 91 wherein the optical element 5 here is fastened by means of two detent hooks or locking hooks 13 to an electrical connection element in form of a connector 92. To this end, the connector 92 has two lateral locking recesses 93, into which corresponding detent tabs or locking tabs 94 of the respective locking hook 13 are introduced. The connector 92 comprises different electrical terminal elements 95, for example terminal pins or conductor barrels.

Figure 22:
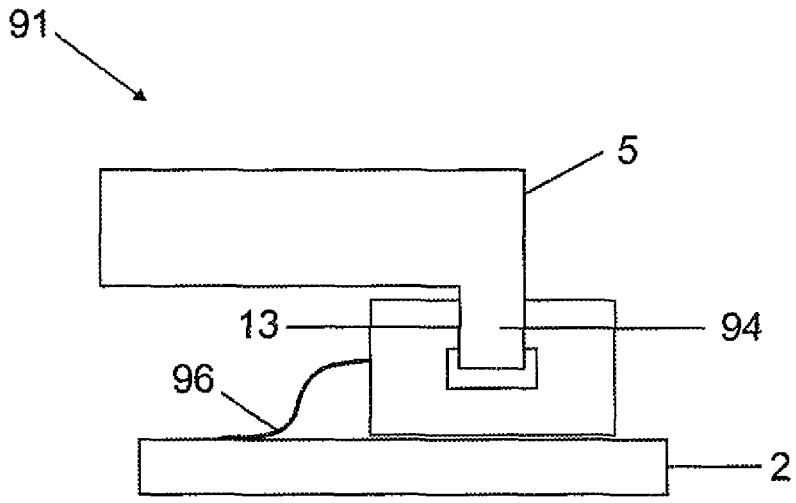
FIG. 22 shows a detail side view of the lighting module according to the ninth embodiment.

FIG. 22 shows a detail side view of the lighting module 91. The connector 92 comprises terminal lugs 96 for making electrical contact with the circuit board 2. The connector 92 is also a surface-mounted component.

Figure 23:
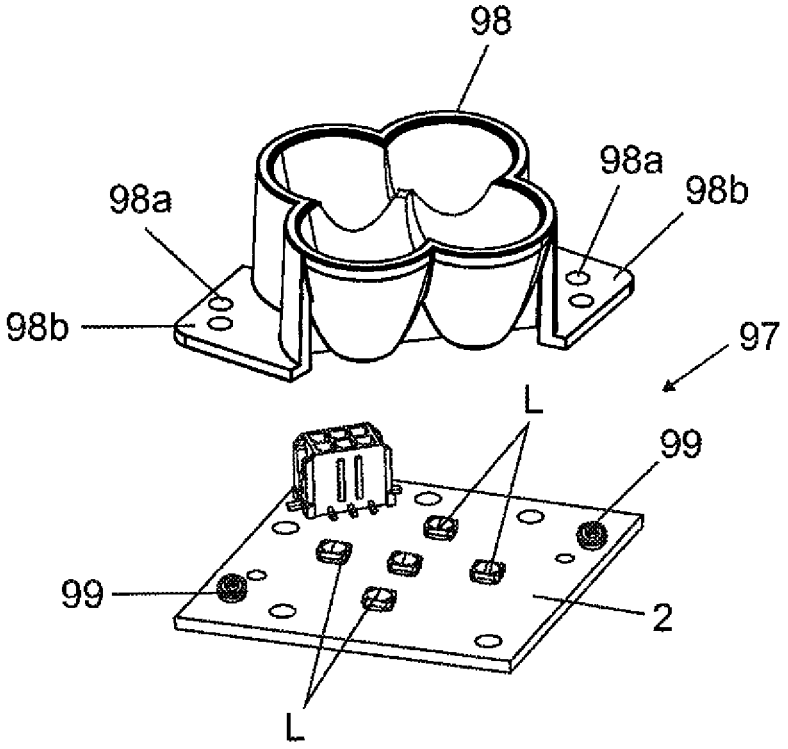
FIG. 23 shows a perspective view of a lighting module according to the invention according to a tenth embodiment.

FIG. 23 shows a perspective view of a lighting module 97 according to the invention having a circuit board 2, light emitting diodes L and an optical element 98 designed as a reflector 98, which is not yet assembled. The optical element 98 comprises openings 98*a* which engage in locking elements 99 and thus fix the reflector 98 on the circuit board 2 by means of two retaining sections 98*b*, as shown in FIG. 24.

Figure 24:
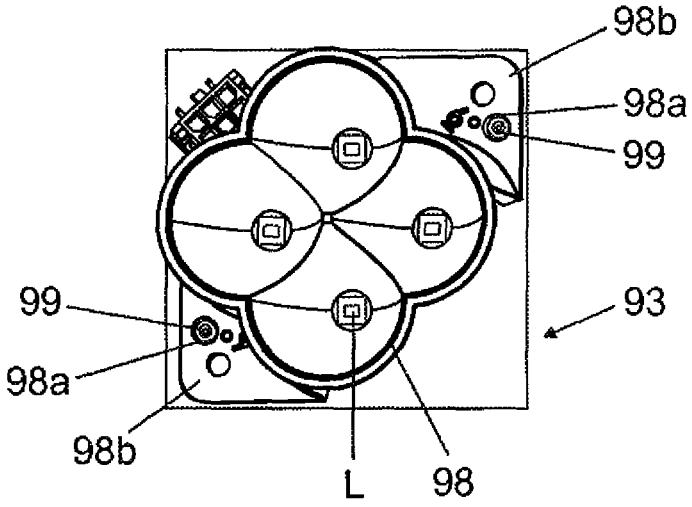
FIG. 24 shows a perspective view of a lighting module according to the invention according to a tenth embodiment.
Figure 25:
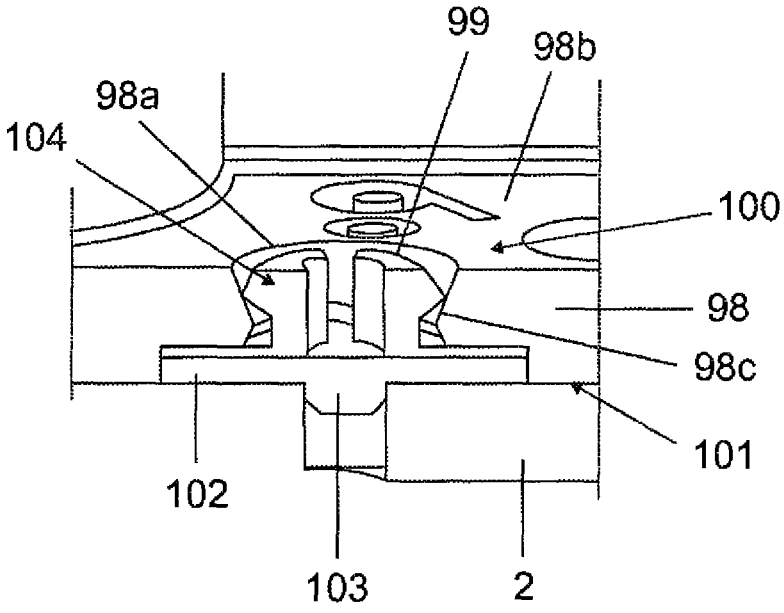
FIG. 25 shows a sectional detail view of the lighting module according to FIGS. 23 and 24.

FIG. 25 shows a sectional detail view of the lighting module 93 according to FIGS. 23 and 24. In the present exemplary embodiment the opening 98*a* has a conical form both towards the upper side 100 and towards the underside 101 of the retaining section 98*b*, which facilitates the introduction of the locking element 99 on the underside 101. The conicity towards the upper side 100 defines the force which is needed in order to release the locking connection again. The shallower the angle between the surface 100 and the edge 98*c* of the opening 98*b*, the greater is the force required. This means that a subsequent exchange of the optical element 98 can be either enabled, facilitated, rendered more difficult or prevented through choice of the appropriate angle. The locking element 99 consists essentially of a base plate 102 which has on its underside, in other words towards the circuit board 2, a positioning stud 103 and on its upper side four locking hooks 104.

Figure 26:
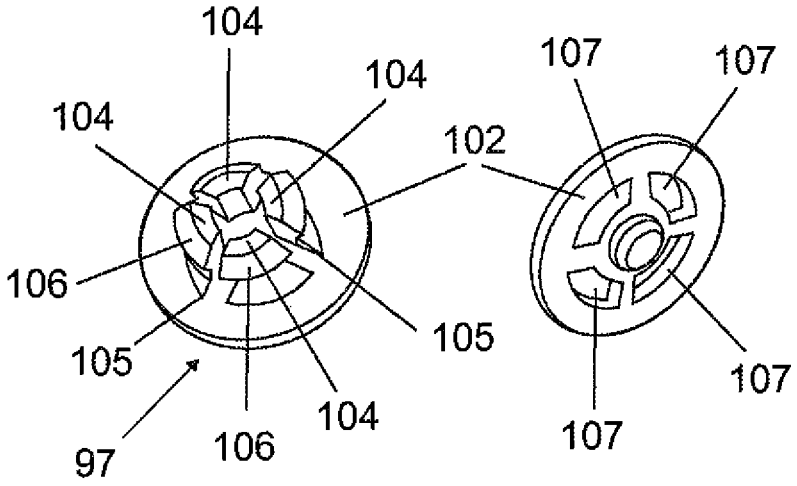
FIG. 26 shows a perspective view of a locking element of a lighting module according to FIGS. 23 and 24.

FIG. 26 shows a perspective view from above (left) and from below (right) of the locking element 99. The locking hooks 104 are arranged in a ring and separated from one another by grooves 105, which results in simple manufacture and a defined force for deflection of the locking hooks 104 when introduced into the opening 98*a*. The locking tabs 106 of the locking hooks 104 are directed outwards. The base plate 102 comprises four openings 107 which are arranged radially outside the locking hooks 104. As a result, the manufacture of the locking element 99 in a casting process, in particular an injection molding process, is facilitated because a two-part mold can be used for manufacturing and a simple molding of the locking element 99 is nevertheless possible.

The locking element 99 is formed from a polymer material and galvanized, in other words provided with a metallic coating, whereby in particular polyamides or so-called LCPs (liquid crystal polymers) are suited for this purpose because they exhibit the necessary temperature stability for the soldering process for fastening on the circuit board 2. Also conceivable however are locking elements made of a pure metal or a metal alloy which can then be produced by means of the usual manufacturing methods for metal components, such as for example casting, milling, punching.

Figure 27:
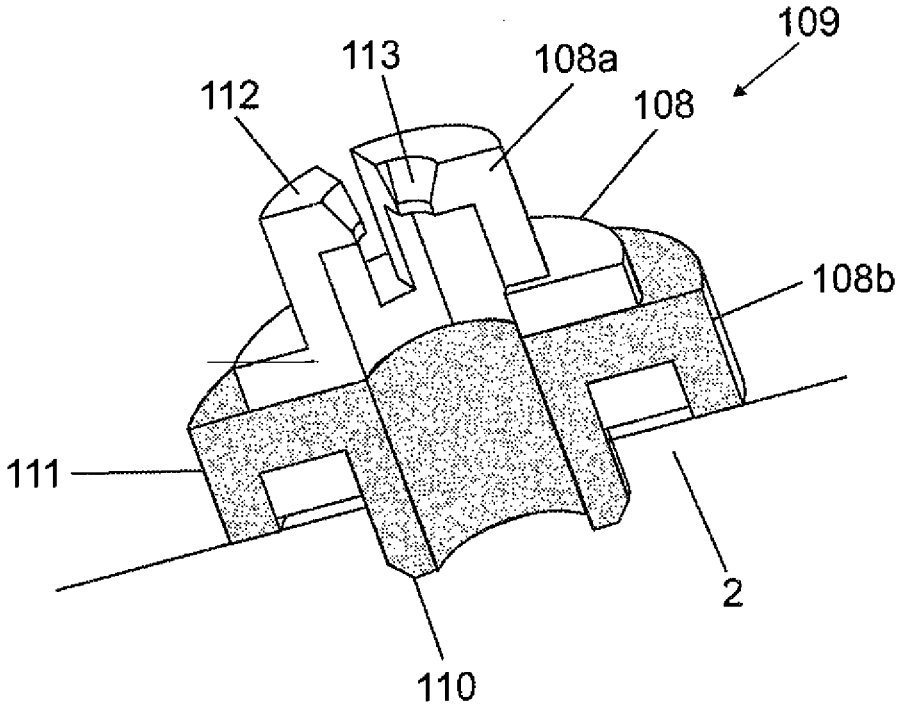
FIG. 27 shows a perspective sectional detail view of a lighting module according to an eleventh embodiment.

FIG. 27 shows a sectional view of another embodiment of a lighting module 109 according to the invention. A locking element 108 is fastened on a circuit board 2 by means of an SMD soldering process. The locking element 108 comprises a positioning stud 110, a base plate 111 and locking hooks 112. The positioning stud 110 is used for secure positioning of the locking element 108 on the circuit board 2 both during the manufacturing process and also in actual use. In this embodiment, the locking hooks 112 are likewise arranged in a ring, whereby the locking tabs 113 of the locking hooks 112 are directed inwards.

Figure 28:
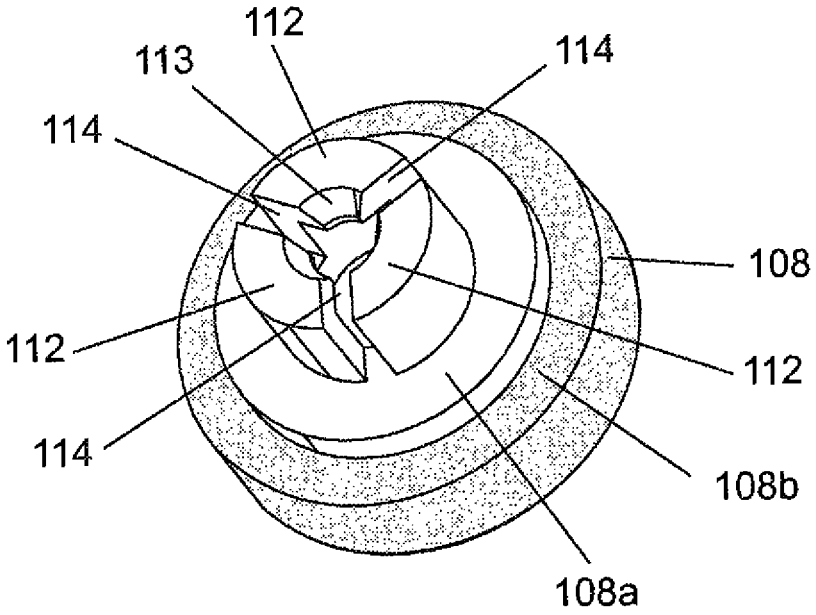
FIG. 28 shows a perspective view of a locking element of a lighting module according to FIG. 27.
Figure 29:
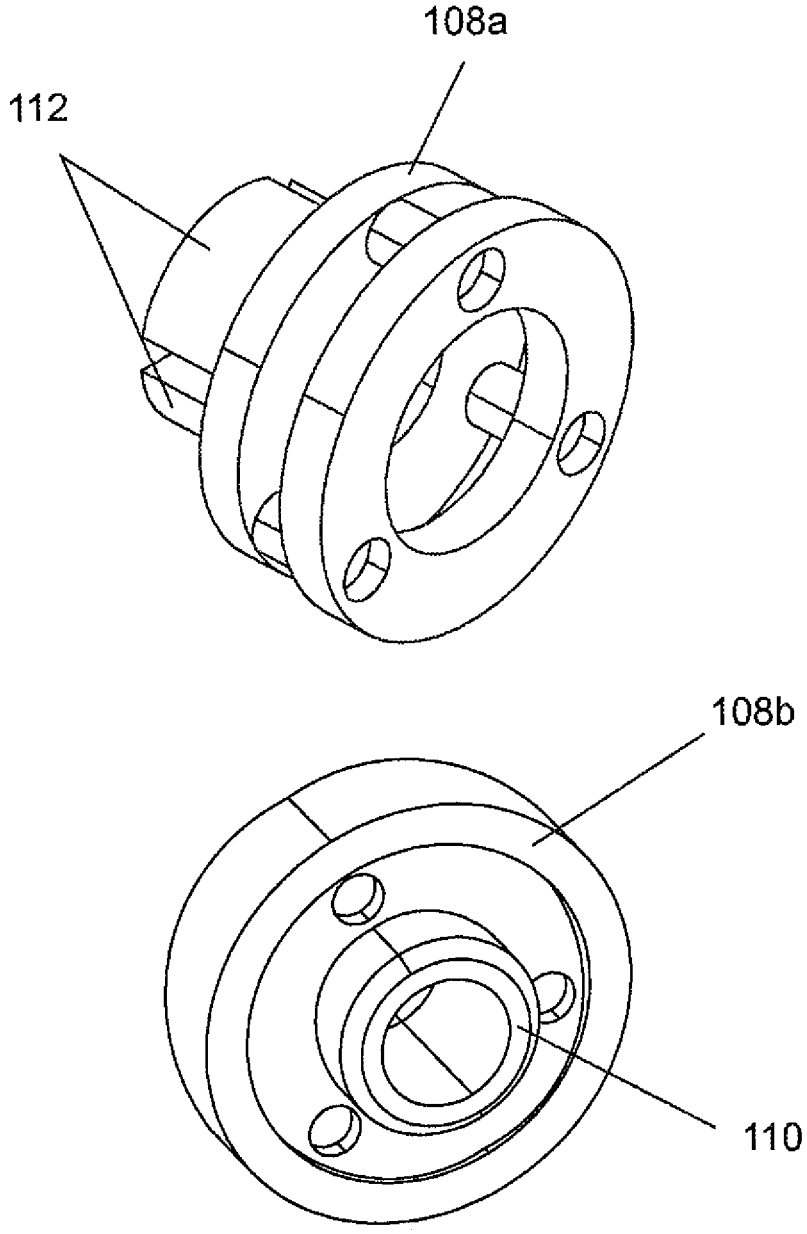
FIG. 29 shows a perspective view of a locking element of a lighting module according to FIG. 27.

As can be seen in FIG. 28, which shows a perspective view of the locking element 108, the locking tabs 113 are separated from one another by three grooves 114, whereby the size and number of the grooves depend on the forces required in order to lock the locking connection, in other words embodiments having one, two or a plurality of grooves are also conceivable. The locking element 108 is produced using the 2-component injection molding process, whereby the parts 108*a*, 108*b* produced from two components are indicated in FIGS. 27 and 28 by a different hatching. In FIG. 29, separate illustrations of the parts 108*a*, 108*b* of the locking element 108 produced from the two components are shown to facilitate understanding, whereby the non-hatched components 108*a* from FIGS. 27 and 28 are illustrated at the top and the hatched component 108*b* from FIGS. 27 and 28 is illustrated below.

High temperature resistant polymer materials, such as for example polyamide or LCP, are again also suitable for the locking element 108, whereby in the present exemplary embodiment the one component (non-hatched) consists of a material which is simple to galvanize and the hatched component consists of a material which cannot be galvanized or only galvanized with difficulty. This means that it is possible to apply the galvanic coating only where it is actually required and complex masking work is dispensed with which would otherwise be needed in order to avoid solder from the soldering process being deposited at locations of the locking element 108 at which this would be a hindrance for example when fastening a locking counter-element.

Figure 30:
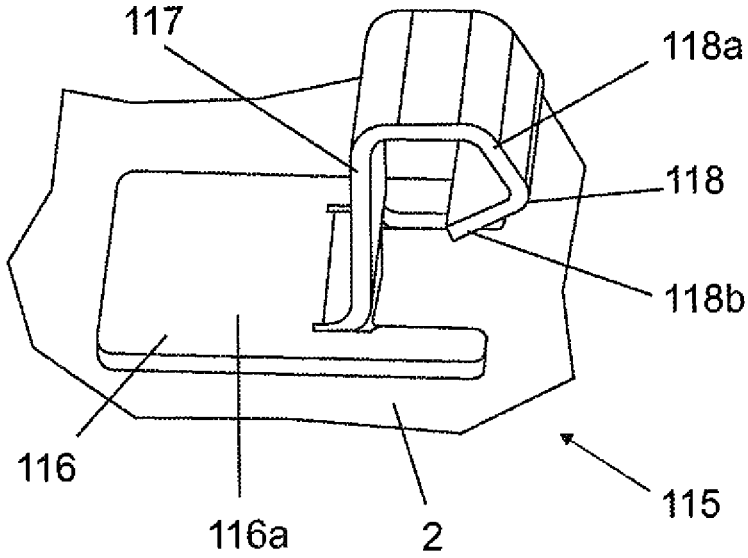
FIG. 30 shows a perspective view of a locking element of a lighting module according to a twelfth embodiment.

FIG. 30 shows a perspective view of a further exemplary embodiment of a lighting module 115 according to the invention having a locking element 116. This is a metal spring 116 which can be manufactured and processed particularly simply as a punched part. From a base plate 116*a*, which can be easily connected with the circuit board 2 by means of an SMD soldering process, a locking arm 117 protrudes which carries a locking hook 118. The locking hook 118 comprises two sections 118*a*,118*b* inclined with respect to the vertical, of which the first section 118*a* through its inclination facilitates the introduction of a locking counter-element, not illustrated here, while the second section 118*b* through its inclination in turn defines the resistance which is needed in order to release the locking connection.

Figure 31:
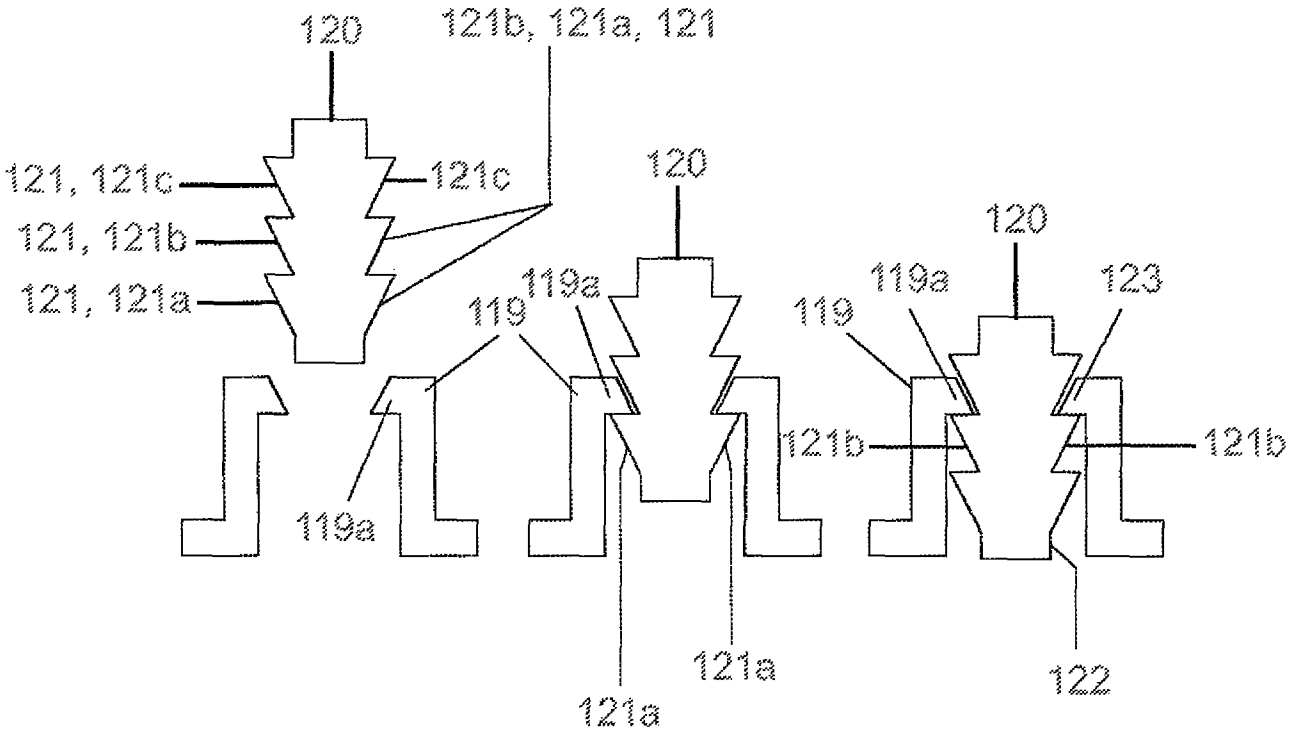
FIG. 31 shows a side sectional view of a locking connection for a lighting module according to a thirteenth embodiment.

FIG. 31 shows a detail sectional view of a further embodiment of the invention in three different states. A locking element 119 is fastened as an SMD component on a circuit board 2 (not illustrated here). A locking counter-element 120 is introduced, as shown at left in FIG. 31, into the locking element 119, whereby the locking counter-element 120 comprises three locking tabs 121. FIG. 31 center shows the locking counter-element 120 in a first locking position in which the first locking tabs 121*a* engage in the locking element 119. FIG. 31 left shows a position in which the second locking tabs 121*b* of the locking counter-element 120 engage in the locking element 119. If the third locking tabs 121*c* should also engage in the locking element 119, then either a taller locking element 119 is necessary or a depression or opening must be provided in the circuit board 2 in the region beneath the locking counter-element 119. If the depression or opening is designed with its cross-section matching the lower part 122 of the locking counter-element 120, improved positioning can be achieved. Depending on the application, the cross-section of the locking counter-element 120 can naturally have any desired form, although simple designs such as circular or rectangular cross-sections are preferred for manufacturing reasons. The configuration and design of the locking element 119, for example through the configuration of individual locking hooks 119*a*, will accordingly likewise be based on the cross-section of the locking counter-element 120.

Through the use of a plurality of locking tabs 121 on the locking counter-element 120 (or optionally also on another part of a locking connection), the vertical position of a component fastened on the locking counter-element 120, thus for example of an optical element, can be chosen in relation to the circuit board 2 and thus also to an LED L in different positions. This allows compensation for measurement tolerances or, depending on the design of the components, also an adjustment of the contact force with which the component connected to the locking counter-element is pressed onto the circuit board 3 or a part connected to it. It is furthermore possible to use an identical component connected to the locking counter-element 120 with different locking elements 119, in particular those having a differing mounting height, which can simplify the manufacturing process for lighting modules. Depending on the application situation, such a locking facility can naturally be provided on the locking element and/or on the locking counter-element.

The present invention is naturally not restricted to the exemplary embodiments shown.

Instead of the optical element, a different attachment element can therefore generally also be used.

For locking purposes the optical element can also comprise at least one locking spring and/or at least one locking receptacle, and the component (locking element, light emitting diode, connector, etc.) can comprise or be at least one locking pin and/or at least one locking hook.

The lighting device can for example comprise a cooling body, to which are fastened one or more lighting modules by their back side. The form of the cooling body is not restricted to the exemplary embodiments shown. Each of the lighting modules shown can be mounted on the cooling body shown or a different cooling body.

Features of the different exemplary embodiments can generally be combined, for example through the use of attachment elements having a different locking connection to the same lighting module, of differently constructed lighting modules on the same cooling body, or even of different types of locking connections to the same attachment element.

The invention claimed is:

1. A lighting module, comprising:

a circuit board, on which are mounted at least one component and at least one attachment element;

wherein the at least one attachment element is fastened on the at least one component mounted on the circuit board in a locking manner, and wherein at least the at least one component is a surface-mounted component.

2. The lighting module as claimed in claim 1, wherein the at least one component comprises at least one light source.

3. The lighting module as claimed in claim 1, wherein the lighting module is provided with its back side for fastening to a cooling body.

4. The lighting module as claimed in claim 2, wherein the at least one attachment element is an optical element assigned to the at least one light source.

5. The lighting module as claimed in claim 1, wherein the at least one attachment element is fastened to a locking element in a locking manner.

6. The lighting module as claimed in claim 1, wherein the at least one attachment element is fastened to an electrical connection element in a locking manner.

7. The lighting module as claimed in claim 2, wherein the at least one attachment element is fastened to the at least one light source in a locking manner.

8. The lighting module as claimed in claim 1, wherein the circuit board is completely equipped with surface-mounted components.

9. The lighting module as claimed in claim 1, wherein the at least one attachment element is fastened in a locking manner to the at least one component by at least one pair consisting of a locking spring and a locking pin which can be inserted in a locking manner into the locking spring.

10. The lighting module as claimed in claim 1, wherein the at least one attachment element is fastened in a locking manner to the at least one component by at least one pair consisting of a locking receptacle and a locking hook hooking laterally on the locking receptacle.

11. The lighting module as claimed in claim 1, wherein the at least one attachment element is fastened in a locking manner to the at least one component by at least one pair consisting of a locking receptacle provided with an opening and a locking pin which can be inserted into the opening.

12. The lighting module as claimed in claim 1, wherein the at least one attachment element is fastened in a locking manner to the at least one component by at least one pair consisting of a locking plate provided with an opening and a slotted locking pin configured to be inserted into the opening, whereby the opening in the locking plate is situated above a recess in the circuit board.

13. The lighting module as claimed in claim 1, comprising at least one pawl for securing the locking fastening of the at least one attachment element to the at least one component.

14. The lighting module as claimed in claim 1, wherein the at least one attachment element has at least one positioning pin.

15. A lighting device, comprising at least one lighting module as claimed in claim 1, also comprising at least one cooling body, wherein the at least one lighting module is fastened by its back side to the at least one cooling body in a planar manner.

16. A method for assembling a lighting module as claimed in claim 1, wherein the method comprises the steps of:

equipping a circuit board with components employing SMT technology; and locking at least one attachment element to one of the SMT components.

17. The method for assembling a lighting device as claimed in claim 16, comprising the step:

planar application of at least one lighting module by a respective back side of the circuit board to a cooling body.

* * * * *